US006393847B1

(12) United States Patent
Brooks et al.

(10) Patent No.: US 6,393,847 B1
(45) Date of Patent: May 28, 2002

(54) LIQUID CRYOGEN FREEZER

(75) Inventors: Jeffrey Brooks, Jasper; Keith Gustafson, Waleska, both of GA (US)

(73) Assignee: Chart Inc., Burnsville, MN (US)

( * ) Notice: Subject to any disclaimer, the term of this patent is extended or adjusted under 35 U.S.C. 154(b) by 0 days.

(21) Appl. No.: 09/759,692

(22) Filed: Jan. 12, 2001

(51) Int. Cl.[7] ..... F25B 19/00
(52) U.S. Cl. ..... 62/51.1; 62/48.1
(58) Field of Search ..... 62/51.1, 48.1

(56) References Cited

U.S. PATENT DOCUMENTS

| | | | | |
|---|---|---|---|---|
| 3,909,225 A | | 9/1975 | Rooney | 62/514 |
| 4,344,302 A | | 8/1982 | Jarrett, Jr. et al. | 62/514 R |
| 4,712,607 A | | 12/1987 | Lindemans et al. | 165/30 |
| 5,275,007 A | | 1/1994 | Neeser | 62/49.2 |
| 5,357,758 A | | 10/1994 | Andonian | 62/45.1 |
| 5,419,143 A | | 5/1995 | Leonard et al. | 62/51.1 |
| 5,590,537 A | * | 1/1997 | Vogel | 62/51.1 |
| 5,906,101 A | | 5/1999 | Rajotte et al. | 62/51.1 |

* cited by examiner

*Primary Examiner*—Ronald Capossela
(74) *Attorney, Agent, or Firm*—Piper Marbury Rudnick & Wolfe

(57) ABSTRACT

An improved liquid cryogen dewar for storing cryobiological materials is disclosed having an inner tank with a reservoir holding a pool of liquid cryogen. A rotatable tray is contained within the inner tank, containing a platform, vertical dividers and a thermally conductive cylindrical outer sleeve, which contains a skirt extending into the pool of liquid cryogen. The sleeve transfers entering heat away from the cryobiological materials and into the liquid cryogen pool. The sleeve maintains a consistently low temperature throughout the vertically disposed shelves of the cryobiological materials contained within the inner tank.

11 Claims, 7 Drawing Sheets

| | Top Shelf | Middle Shelf | Bottom Shelf |
|---|---|---|---|
| Al Skirted tray AL racks | -183.8 C | -188.7 C | -189.9 C |
| Al Skirted tray SS racks | -182.6 C | -185.8 C | -187.5 C |
| Al Skirted tray SS racks w/lid open | -162.0 C | -176.1 C | -183.8 C |

Location in storage rack

LIQUID CRYOGEN FREEZER

BACKGROUND OF THE INVENTION

This invention relates generally to the field of cryogenic storage devices and, more particularly, to an improved cryogenic dewar having a tray for holding specimens, the tray including a thermally conductive, cylindrical sleeve, containing a skirt which is at least partially immersed in liquid cryogen.

Vapor phase liquid cryogen freezers have been used for several decades for long term storage of biological specimens, which are heat sensitive. Normally, a frozen specimen is placed into a storage container, which is stored in a dewar. A typical dewar 10, shown in FIG. 1, contains an outer shell 12 housing inner tank 14, separated from inner shell 16 by vacuum-insulated space 18. Inner tank 14 is closed using lid 34.

A stainless steel turn tray 30 holds a number of stainless steel storage racks 32 with shelves 33, where vials of biological specimens are placed in boxes on the shelves 33 for storage. The racks 32 rest on a circular, stainless steel, turn tray platform 26 welded to the remainder of the tray. Vertical dividers 24 separate turn tray 30 into sections, each of which may hold one or more racks 32. For example, four dividers may be used to separate tray 30 into quadrants.

A cylindrical sleeve 36, made of stainless steel and welded to the edges of dividers 24, surrounds tray 30. Sleeve 36 and dividers 24 cooperate to help maintain the storage racks 32 placed between dividers 24 in an upright position by keeping the racks 32 from tipping over within their particular sections. The sleeve 36 of the prior art dewar extends upwardly from platform 26 to the top of vertical dividers 24.

Dividers 24 and platform 26 are welded to a stainless steel central tube 28 to allow tray 30 to rotate within inner tank 14. To access storage racks 32, a user rotates tray 30 using handles 20 attached to the top edge of dividers 24, until a desired rack 32 is positioned underneath lid 34, whereby a desired specimen may be acquired by removal of the rack 32.

The bottom of the inner tank is a reservoir for a pool of liquid cryogen 40, such as liquid nitrogen. As the nitrogen receives heat transferred from outside of dewar 10, via inner shell 16 and lid 34, a portion of the nitrogen evaporates to produce a cold vapor, which surrounds the storage racks 32. This type of cold storage, known as "vapor phase" storage, prevents cross-contamination of the biological specimens stored within dewar 10. The nitrogen vapor passes through apertures 25 within dividers 24 and platform 26.

A primary concern of such vapor phase storage is maintaining a desired, low temperature at the storage racks, particularly at the upper shelves. While liquid nitrogen at the bottom of the dewar remains at a constant temperature (about −196° C.), and while vapor near the liquid nitrogen approaches this temperature, ambient heat entering from the walls and lid of the container warm the vapor above the liquid pool. This warmer vapor migrates to the upper portions of inner tank 14, and thus to the specimens contained on the upper shelves. A temperature gradient of as much as 100° C. can exist from the bottom of the dewar to the top. This difference is significant, because it is accepted that diffusion within biological specimens can begin to occur at temperatures as warm as −132° C. Keeping the temperature of the specimens under this threshold is thus a significant concern. Storage below −150° C. is generally accepted by the industry as safe since it is below the threshold for diffusion by a safe margin to allow for temperature fluctuation in the freezer.

Past efforts to decrease the temperature gradient, and thereby lower the upper shelf temperatures, fall into two categories. The first is improving the insulation efficiency of the dewars, which indeed lowers the temperature gradient for a closed dewar. However, once the lid of the dewar is opened, heat enters the dewar, adversely affecting, the top shelves. The top shelves can get quite warm (about −50° C.), and there is a slow recovery time for the shelves to revert to a cooler temperature.

A second solution is making the shelving and rack out of aluminum or a similar metal with high thermal conductivity. While at steady state temperatures, with the lid closed, this method appears to solve the problem, but it is actually worsened when the dewar lid is opened to add or remove samples. As heat enters the dewar through the open lid, the aluminum shelving and rack transfer significant heat to the lower shelves. This is because the nitrogen vapor is a poor thermal conductor and doesn't effectively transfer the heat to the liquid nitrogen pool below.

Accordingly, an improved cryogenic freezer, which has a lower temperature gradient from the bottom to the top, and that can keep the top shelves at a relatively constant temperature, below a desired threshold, is needed.

It is an object of the invention to provide a liquid cryogen freezer that prevents specimens stored within the freezer from exceeding a desired threshold temperature.

It is a further object of the invention to provide a dewar that significantly lowers the temperature gradient.

It is a further object of the invention to provide a liquid cryogen freezer that allows a user to quickly and easily access desired biological specimens within the freezer, while maintaining a safe temperature for the specimens.

It is a further object of the invention to provide a liquid cryogen freezer that reduces the time of the dewar to recover to steady state storage conditions after the lid has been opened.

It is a further object of the invention to provide a liquid cryogen freezer that maintains a nearly uniform steady state temperature within the dewar, even when the lid of the dewar is opened.

SUMMARY OF THE INVENTION

The present invention overcomes the shortcomings of the prior art, and consists of a dewar with an improved turn tray having a sleeve made of a thermally conductive material. The sleeve of the improved tray has a thermally conductive skirt extension, which extends below the floor of the tray so as to be at least partially immersed in the pool of liquid nitrogen contained in the inner tank. The sleeve extends upwardly to a level substantially even with the top of the storage racks.

The sleeve is in direct contact with the liquid nitrogen and is an excellent thermal conductor. Heat entering the tank through the lid is rapidly transferred into the liquid nitrogen pool below via the sleeve instead of into the nitrogen vapor surrounding the stored specimens. This, in turn, increases evaporation of the liquid nitrogen producing additional cool vapor that reaches the top storage shelves more quickly than in prior art dewars thereby decreasing the time required for the dewar to recover to steady state conditions. As a result, the temperature gradient is significantly decreased and the upper storage shelves are maintained at a safe temperature.

DETAILED DESCRIPTION OF THE INVENTION

Figure 1:
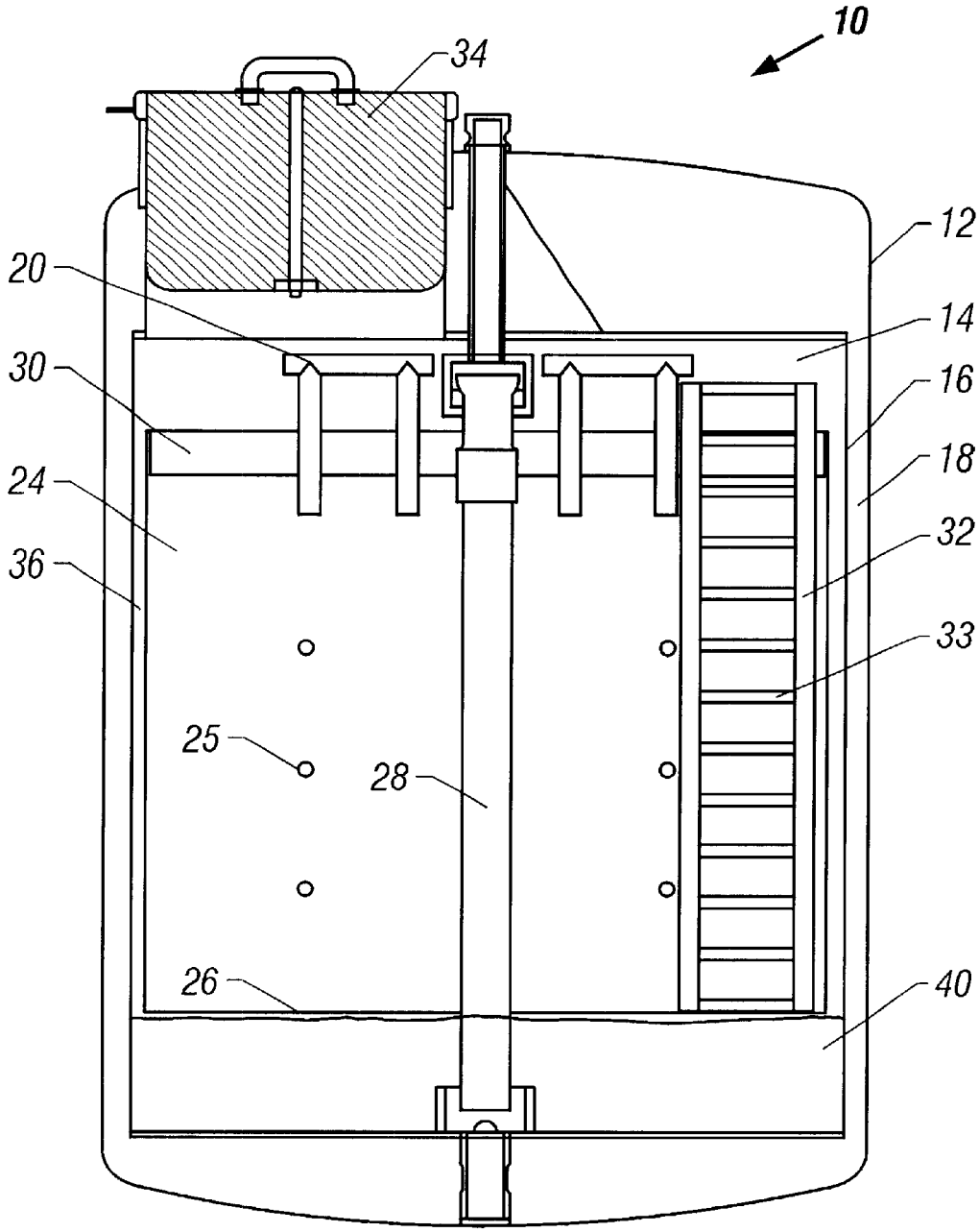
FIG. 1 (Prior Art)
FIG. 1 is a perspective view of a prior art dewar, cut away so as to show the inner tank and turn tray.
Figure 2:
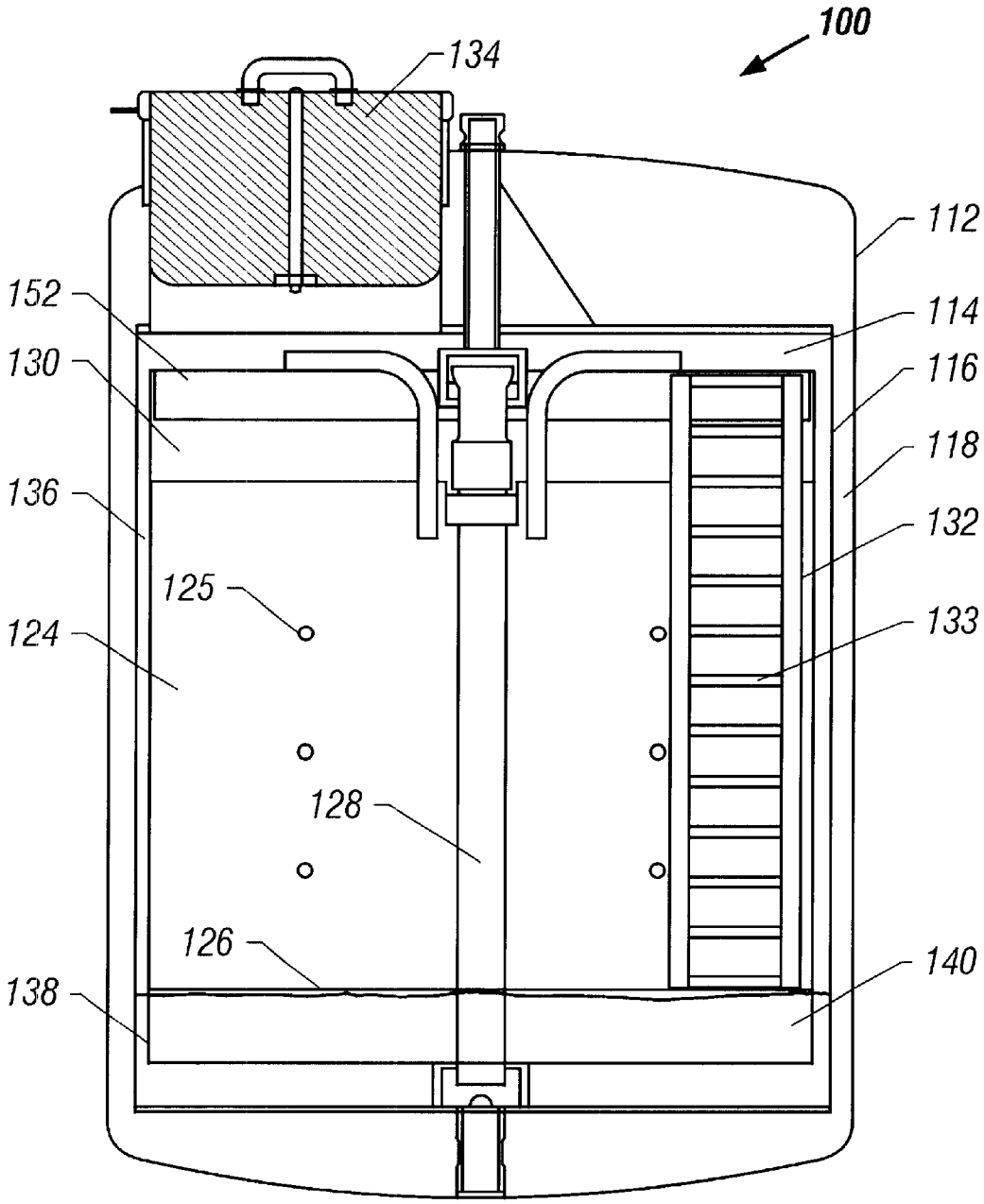
FIG. 2 is a perspective view of a dewar using the improved turn tray of the present invention, cut away so as to show the inner tank and turn tray.

Referring more particularly to FIG. 2, according to a preferred embodiment of the invention, the invention consists of a dewar 100, having an improved turn tray 130 with an outer sleeve 136 which is formed of a thermally conductive material, such as aluminum or copper. The turn tray 130 is rotatably housed within dewar 100. Sleeve 136 contains a thermally conductive skirt extension 138 which extends downwardly below turn tray platform 126 so as to be at least partially immersed in the liquid nitrogen pool 140. It thus acts as a heat conduit or heat sink in conjunction with the liquid nitrogen.

Sleeve 136 is typically formed by rolling a sheet of aluminum into a cylinder so as to surround turn tray 130. Sleeve 136 is welded onto the outer edges of vertical dividers 124 and the outer periphery of platform 126. Skirt extension 138 is typically an integral portion of sleeve 136, as skirt 138 and sleeve 136 are usually one piece. Sleeve 136, including skirt 138, preferably has a thickness of about one-sixteenth inch.

In order to effectively weld sleeve 136 onto vertical dividers 124, the dividers are preferably formed of aluminum. For the same reason, turn tray platform 126 and turn tray tube 128, which are welded components of tray 130, are similarly constructed of aluminum. The rack 132 and shelves 133 are constructed of stainless steel.

Figure 3A:
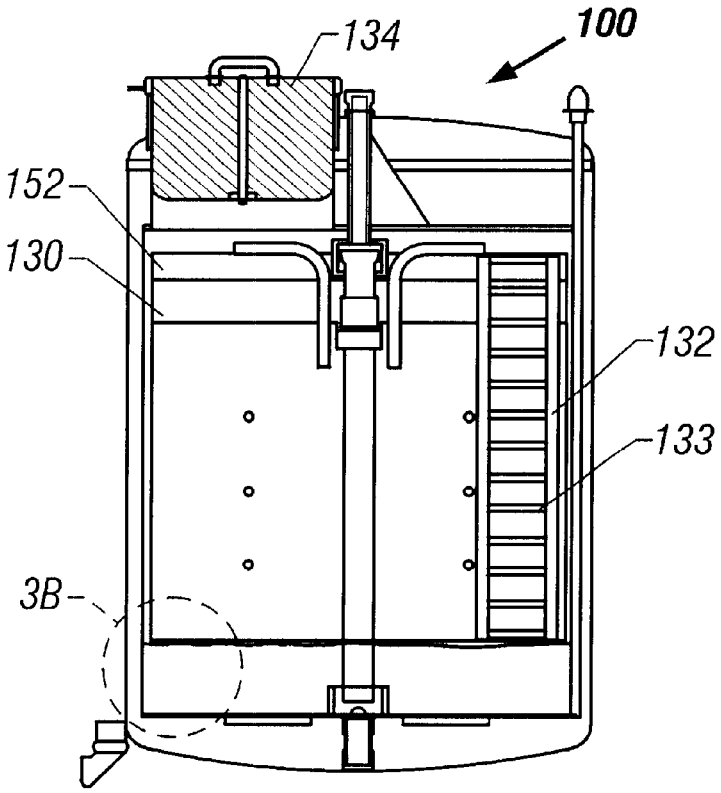
FIG. 3 is a side sectional view of a dewar using the improved turn tray of the present invention.
Figure 3B:
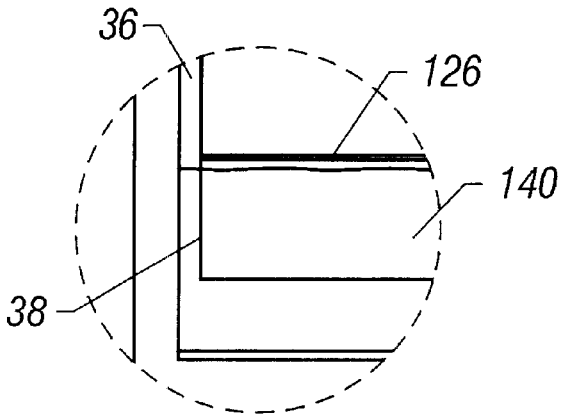

As shown in the enlarged portion of FIG. 3, thermally conductive skirt extension 138, part of sleeve 136, extends below platform 126 into the pool of liquid nitrogen 140, for conductive transfer of heat between sleeve 136 and pool 140. For a sleeve having a height of twenty-six inches, for example, the skirt 138 may extend downwardly beneath platform 126 about three inches.

As shown in FIG. 2, sleeve 136 may also extend upwardly over the top edges of vertical dividers 124 and towards the top of storage shelves 133, to a level substantially even with the top of the racks 132. To reinforce sleeve 136 at the section of the sleeve above the vertical dividers 124, an aluminum, circular stiffener band 152 is rolled and tack welded to the inner tank 114 at the top edge of sleeve 136, extending around the circumference of the sleeve 136.

In operation, sleeve 136 transfers incoming heat from lid 134 and inner shell 116, drawing the heat away from shelves 133, into the liquid nitrogen pool 140 below thus acting as a heat sink. Evaporation of liquid nitrogen is thereby increased, producing additional cold vapor which flows to the top of inner tank 114 more quickly than in the prior art. This decreases the time it takes for the dewar to return to steady state conditions.

As a result of the action of sleeve 136, temperature at the top of inner tank 114, and thus at the top of shelves 133, is lowered. In doing so, the temperature gradient between the top and bottom of the storage shelves is similarly reduced.

In addition to the exemplary structure above, additional embodiments are possible which include an upright, vertically disposed, thermally conductive element such as a rod extending into the pool of liquid nitrogen. Alternatively, the vertical dividers 24 may contain one or more extensions into the liquid nitrogen pool. Or, tube 128 may contain a fin extending into the nitrogen, in thermal connection with a series of fins near the top of the inside of the dewar. These additional embodiments, and others, are contemplated to be within the scope of this invention.

The benefits of the improved dewar are illustrated in the graphs shown in FIGS. 4–7. In each of these graphs, the horizontal axis represents the relative location of a shelf within an inner tank of a dewar. The vertical axis represents a maximum measured temperature at a particular shelf.

Figure 4:
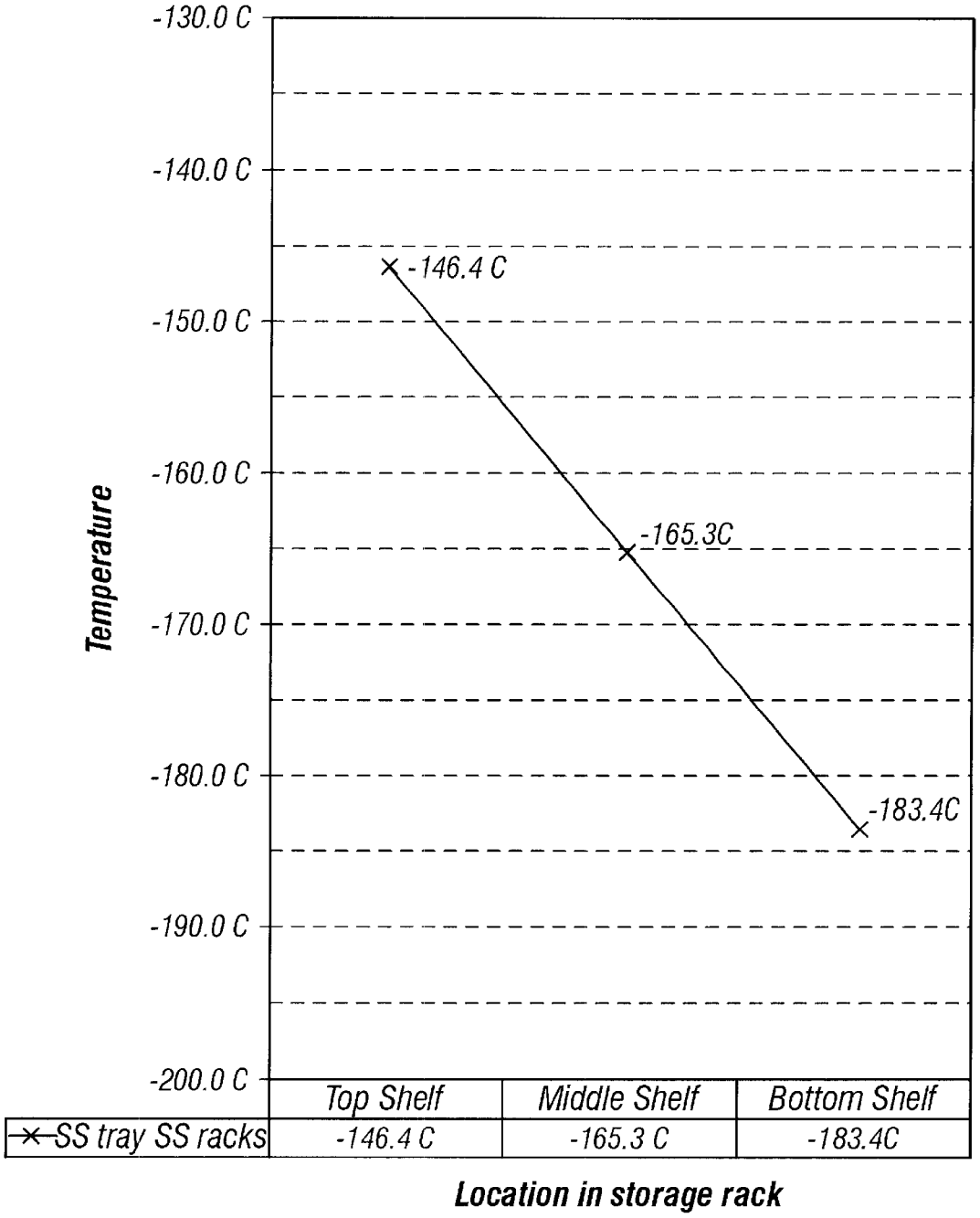
FIG. 4 is a graph showing a relationship between temperature and shelf location for a prior art dewar having a stainless steel tray and stainless steel shelving and storage racks.

FIG. 4 shows the temperatures at the top, middle, and bottom shelves of a prior art dewar having stainless steel shelves and racks with a stainless steel turn tray, without the improvements of the present invention. There is a significant temperature differential of 37° C., resulting in a large temperature gradient. Also the temperature at the top shelf rises to −146.4° C., which is above the threshold temperature where diffusion of cryobiological specimens can occur.

Figure 5:
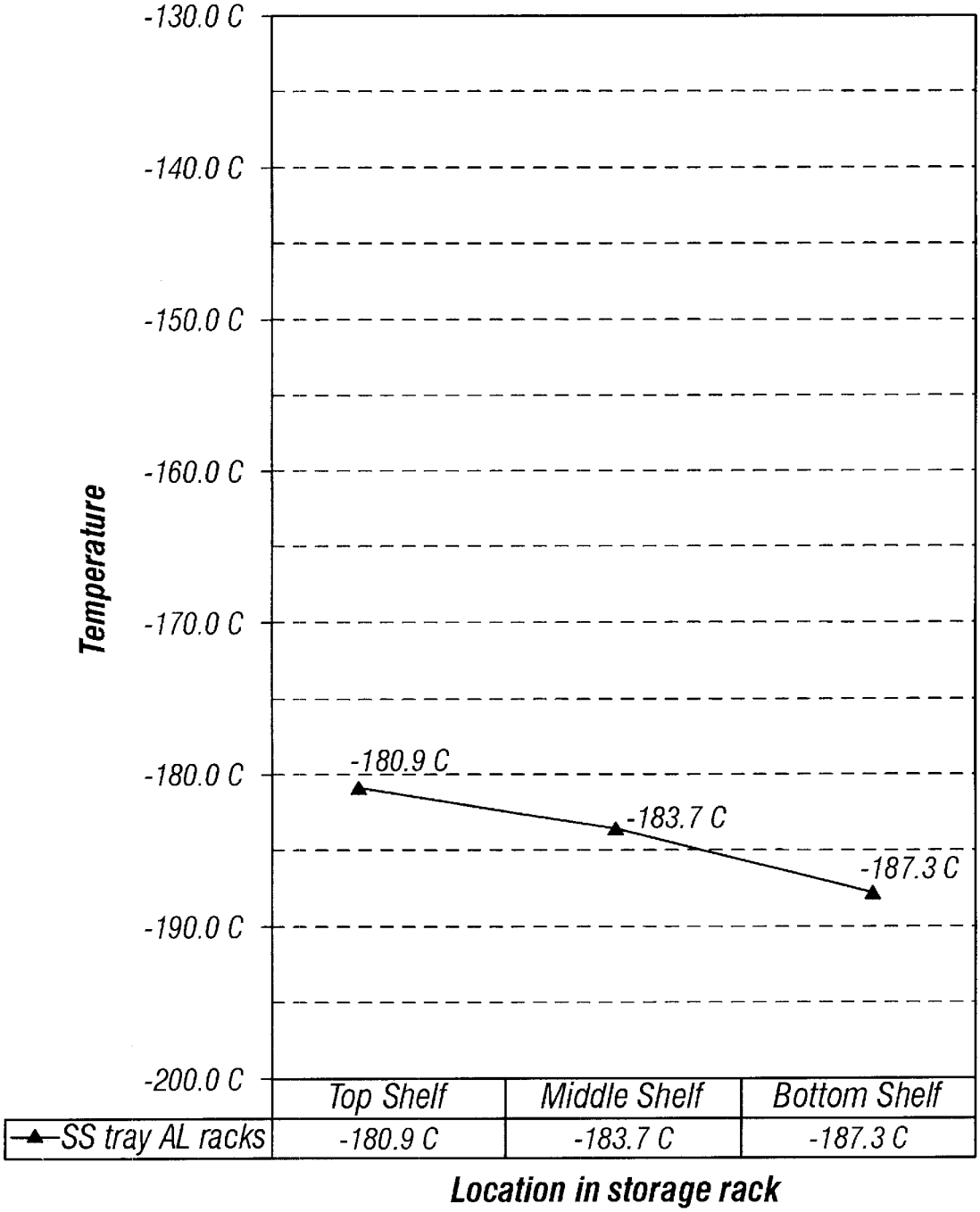
Fig.5 is a graph showing a relationship between temperature and shelf location for a prior art dewar having a stainless steel tray and aluminum shelves and storage racks, at steady state.

FIG. 5 shows a temperature relationship for a similar prior art dewar having a stainless steel tray, but with aluminum shelves and racks. Here the temperature gradient, at steady state, is acceptably small. However, this graph does not account for the instance when the dewar lid is opened. This is shown in FIG. 6.

Figure 6:
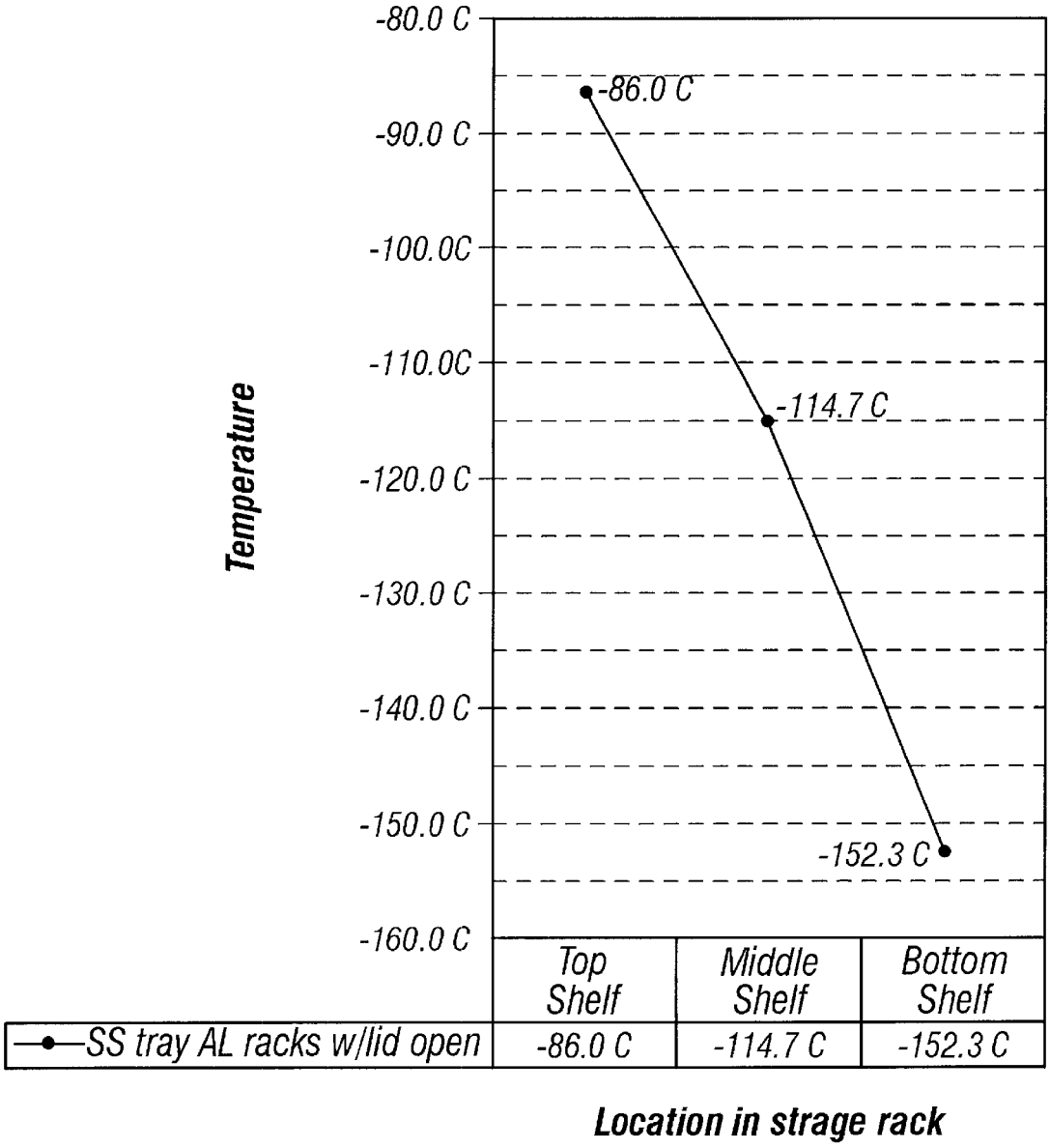
FIG. 6 is a graph showing a relationship between temperature and shelf location for a prior art dewar having a stainless steel tray and aluminum shelves and storage racks, with the dewar lid opened.

FIG. 6 shows the results of opening the lid for a period of time (at least several hours) until equilibrium (stability) is reached within the tank. The gradient is much larger. Also the temperature at the top and middle shelves are significantly above the "safe" storage temperature for cryobiological materials, and that even on the bottom shelf, the temperature is barely below the safe level. This is because the heat from the ambient air is quickly absorbed by the upper shelves, and transferred to the lower shelves. The surrounding vapor (nitrogen, typically) is a poor thermal conductor and does not transfer the heat into the nitrogen pool below rather it warms the sleeves and racks. For a dewar that is frequently opened by a user, this dewar configuration may compound the problem.

Figure 7:
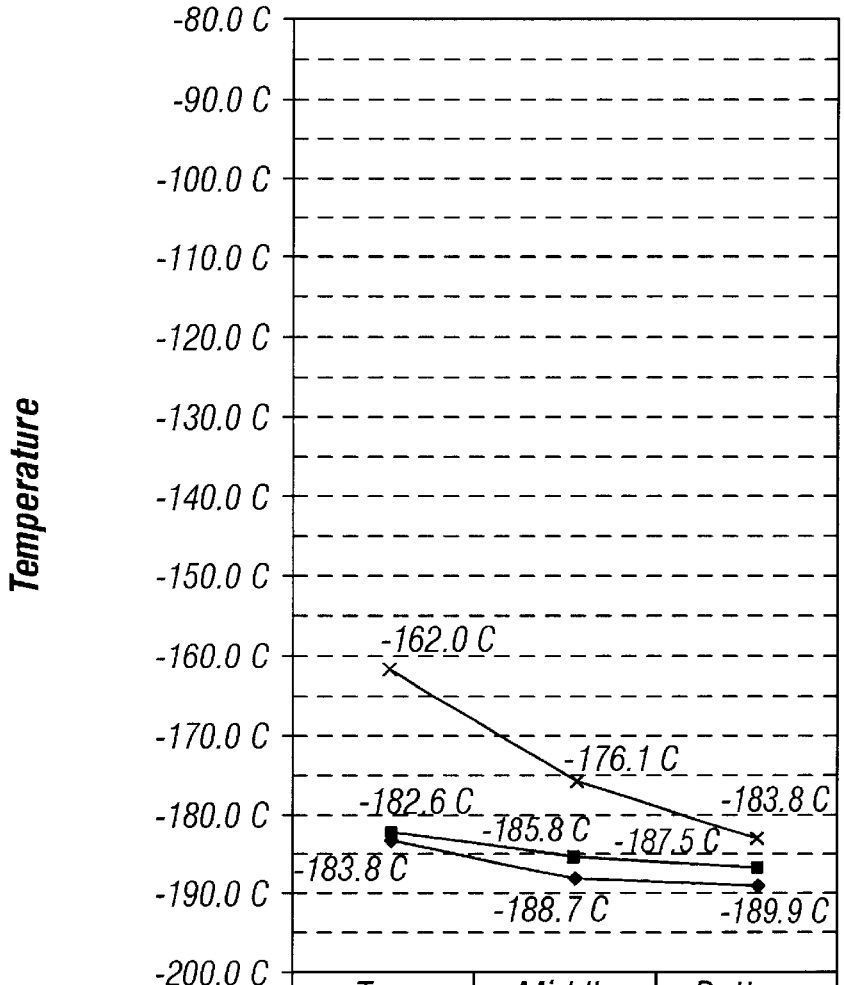
FIG. 7 is a graph showing a series of relationships between temperature and shelf location for dewars representing different embodiments of the present invention.

FIG. 7 shows temperature relationships for two embodiments of dewars of the present invention, both having an aluminum turn tray with a thermally conductive aluminum skirt extension immersed within a pool of liquid nitrogen. A first curve, indicated by diamonds, shows a dewar at steady state having an aluminum turn tray and aluminum shelves and racks. The overall temperatures, as well as the gradient, have decreased slightly as compared to the dewar of FIG. 5. A second curve, indicated by squares, shows a preferred dewar, which has an aluminum tray and stainless steel racks. Here, the temperatures are slightly above those of the dewar having aluminum shelves and racks (FIG. 5), at least at steady state. However, the gradient has been lowered, and the temperatures are all significantly below the safe level of −150° C. The third curve, indicated by asterisks, shows the preferred dewar with stainless steel shelves and racks with the lid open at steady state. The gradient is much smaller than the gradient shown in FIG. 6, and the temperature at the top shelf is safely below −150° C. This improved dewar allows for safer and consistently cooler storage of cryobiological material.

It will be apparent to those skilled in the art that other modifications and variations can be made to the method and system of the instant invention without diverging from the scope, spirit, or teaching of the invention. Therefore, it is the intention of the inventors that the description of the instant invention should be considered illustrative and that the invention is to be limited only as specified in the claims and equivalents thereto.

What is claimed is:

1. In a vacuum insulated dewar having an inner tank with a bottom reservoir containing a pool of cryogenic liquid, a top opening for inserting and removing specimens, and a tray for storing specimens thereon in vertically disposed racks said tray being disposed above the pool of cryogenic liquid, the improvement comprising:

a vertically disposed, cylindrical thermally conductive element connected to the tray, a portion of said cylindrical element extending upwardly to a position near a top of the dewar, said cylindrical element having a portion extending below the tray so as to be, at least partially, immersed in said pool of cryogenic liquid; wherein said cylindrical element surrounds the tray and the specimens stored thereon, whereby said cylindrical element absorbs heat in the dewar and transfers it to the pool of cryogenic liquid, thereby to enhance evaporation so that resulting vapor may rise to limit undesirable temperature rise in the racks located near the top of said dewar.

2. The dewar of claim 1 further comprising:

a plurality of upright dividers connected to the tray for preventing the racks from tipping over within the tray.

3. An insulated container for storing specimens at very low temperatures, comprising:

a bottom reservoir in said container for receiving and holding a pool of liquid cryogen;

a platform adapted to be disposed within said container above the pool of liquid cryogen;

a plurality of storage shelves supported on said platform adapted to receive and store said specimens; and a cylindrical thermally conductive element surrounding the platform and the plurality of storage shelves supported thereon, wherein said cylindrical thermally conductive element extends upwardly from the platform to a position near a top of the container, said cylindrical element having a cylindrical portion extending below the platform adapted to be positioned in the pool of liquid cryogen so as to draw heat from an upper portion of the container and transfer it into the pool of liquid cryogen, thereby to enhance evaporation so that resulting vapor may rise to limit undesirable heat rise in the upper portion of said container.

4. The container of claim 3, wherein said element is a sleeve connected to said platform and the sleeve extends upwardly to a level at least as high as the top of said storage shelves.

5. The container of claim 4, wherein the sleeve is comprised of aluminum.

6. The container of claim 4, further comprising a thermally conductive, cylindrical support band secured to the sleeve at an upper portion thereof.

7. The container of claim 3, wherein the liquid cryogen is liquid nitrogen.

8. The container of claim 3, further comprising a central, vertical tube connected to the platform, and vertical dividers connected to said tube extending outwardly therefrom to divide the tray into sections.

9. The cryogenic container of claim 8, wherein the platform and vertical dividers contain apertures for allowing vapor from the pool of liquid cryogen to circulate therethrough.

10. The container of claim 3, wherein the storage shelves are comprised of stainless steel.

11. In an insulated dewar having an inner tank containing a pool of liquid cryogen and a platform for supporting specimens above the pool of liquid cryogen, means for reducing heat transfer to the specimens, comprising:

an upright, vertically disposed, cylindrical thermally conductive element connected to and surrounding the platform, a portion of the cylindrical element extending upwardly from the platform to a position near a top of the dewar, the cylindrical element having a portion extending below the platform and into the pool of liquid cryogen so as to conduct heat from the top of the dewar into the pool of liquid cryogen, thereby to enhance evaporation so that resulting vapor may rise to limit undesirable heat rise in the upper portion of said dewar.

* * * * *